US007267567B1

(12) United States Patent
Scholeno et al.

(10) Patent No.: US 7,267,567 B1
(45) Date of Patent: Sep. 11, 2007

(54) LAMP SOCKET WITH LEVER HOLDER

(75) Inventors: Michael F. Scholeno, York, PA (US); Shane M. Brown, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/496,412

(22) Filed: Jul. 31, 2006

(51) Int. Cl.
*H01R 33/02* (2006.01)

(52) U.S. Cl. ..... 439/226; 439/372; 439/241

(58) Field of Classification Search ..... 439/226, 439/239, 404, 375, 241
See application file for complete search history.

(56) References Cited

U.S. PATENT DOCUMENTS 6,309,236 B1 * 10/2001 Ullrich ..... 439/226
7,059,888 B2 6/2006 Frappier et al. ..... 439/375

* cited by examiner

*Primary Examiner*—Truc Nguyen
(74) *Attorney, Agent, or Firm*—William E. Meyer

(57) ABSTRACT

A socket (10) for a lamp (12) having a projecting electrical contact (14) at least at one end, the socket (10) comprising: an electrically insulating housing (16) having a bottom surface (18) for attachment to a base (20) and an upper surface (22), the upper surface (22) having a wire-receiving groove (24) formed therein; an electrical contact receiving position (26) formed with the upper surface (22) adjacent the wire receiving groove (24); an electrical contact (28) fixed at the electrical contact receiving position (26), the electrical contact (28) having a tail (30) extending into the wire receiving groove (24); a cover receiving position (32) formed with the upper surface (22) and spaced from the electrical contact receiving position, the cover receiving position (32) including a depression (34); an electrically insulating cover (36) fixed to the cover receiving position, the cover (36) including a wire engaging portion (38) projecting into the wire receiving groove (24) and a boss (40) fitted into the depression (34); and a pivotable lever (42) positioned with and held in place by the cover (36).

4 Claims, 3 Drawing Sheets

LAMP SOCKET WITH LEVER HOLDER

TECHNICAL FIELD

This invention relates to lamp sockets and more particularly to high temperature lamp sockets for double-ended lamps. Still more particularly, it relates to such a socket that includes a lamp removal feature in the form of a pivotable lever.

BACKGROUND ART

Double-ended metal halide arc discharge lamps are known. Some kinds of these lamps have achieved wide usage in entertainment lighting. One particular version of such a lamp is designated SharXS® and is produced by Osram Photo-Optic. Lamps of this type are available from Osram Sylvania Inc., Danvers, Mass. 01923. These lamps are provided in wattages from 200 to 1200 and operate at quite high temperatures. In fact, typical operating temperatures in area of the socket are in the range of 200 to 300° C. It is, of course, imperative that the sockets employed with these lamps also be able to operate for long periods of time at such temperatures and still maintain good electrical contact. One type of socket for double-ended lamps is shown and described in German Gebrauchmuster No. 295 04 517, filed Mar. 22, 1995. The socket utilizes a pair of spaced ceramic bodies containing electrical contacts in the form of a single spring that often results in poor contact resistance. To solve the latter problem a lamp socket has been supplied that provides supplemental springs. Such a socket is shown in pending U.S. patent application Ser. No. 10/930,664, filed Aug. 31, 2004, now U.S. Pat. No. 7,059,888, issued Jun. 13, 2006, and assigned to the assignee of the instant invention and, while it solves the poor resistance problem, makes the lamp somewhat more difficult to remove from the socket because of the high frictional forces existing between the lamp contacts and the socket springs and because many luminaries have limited space, making it extremely difficult for an operator to get his or her hands into an appropriate position to remove an old lamp and insert a new one.

The latter problem is addressed in pending U.S. patent application Ser. No. 11/397,043, filed Apr. 3, 2006 and assigned to the assignee of the instant invention, wherein is taught a lamp socket provided with a bulb removal feature in the form of a pivotable lever. While that solution is workable, mounting the lever and maintaining its position is problem.

DISCLOSURE OF INVENTION

Accordingly, it is an object of the invention to obviate the disadvantages of the prior art.

It is another object of the invention to enhance the operation of lamp sockets.

Yet another object of the invention is provision of a lamp socket containing a simplified bulb removal feature.

These objects are accomplished, in one aspect of the invention, by the provision of a socket for a lamp having a projecting electrical contact at least at one end, wherein the socket comprises: an electrically insulating housing having a bottom surface for attachment to a base and an upper surface, the upper surface having a wire-receiving groove formed therein; an electrical contact receiving position formed with the upper surface adjacent the wire receiving groove; an electrical contact fixed at the electrical contact receiving position, the electrical contact having a tail extending into the wire receiving groove; a cover receiving position formed with the upper surface and spaced from the electrical contact receiving position, the cover receiving position including a depression; an electrically insulating cover fixed to the cover receiving position, the cover including a wire engaging portion projecting into the wire receiving groove and a boss fitted into the depression; and a pivotable lever positioned with and held in place by the cover.

Mounting the lever with the cover allows cover movement without loss of the lever.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
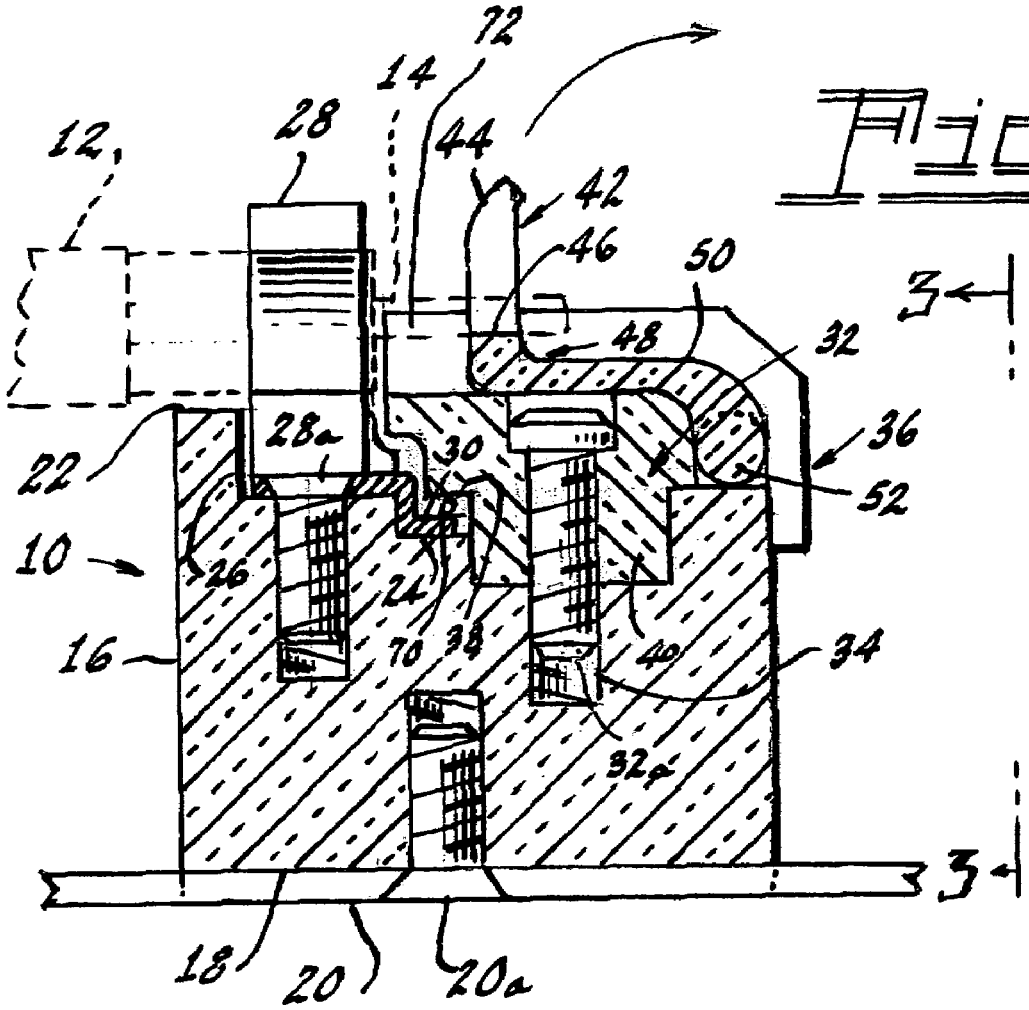
FIG. 1 is an elevational, sectional view of an embodiment of the invention.
Figure 2:
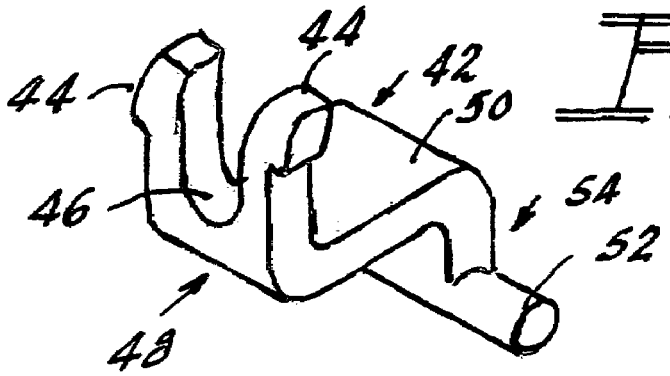
FIG. 2 is a perspective of a lever used with an embodiment of the invention.
Figure 3:
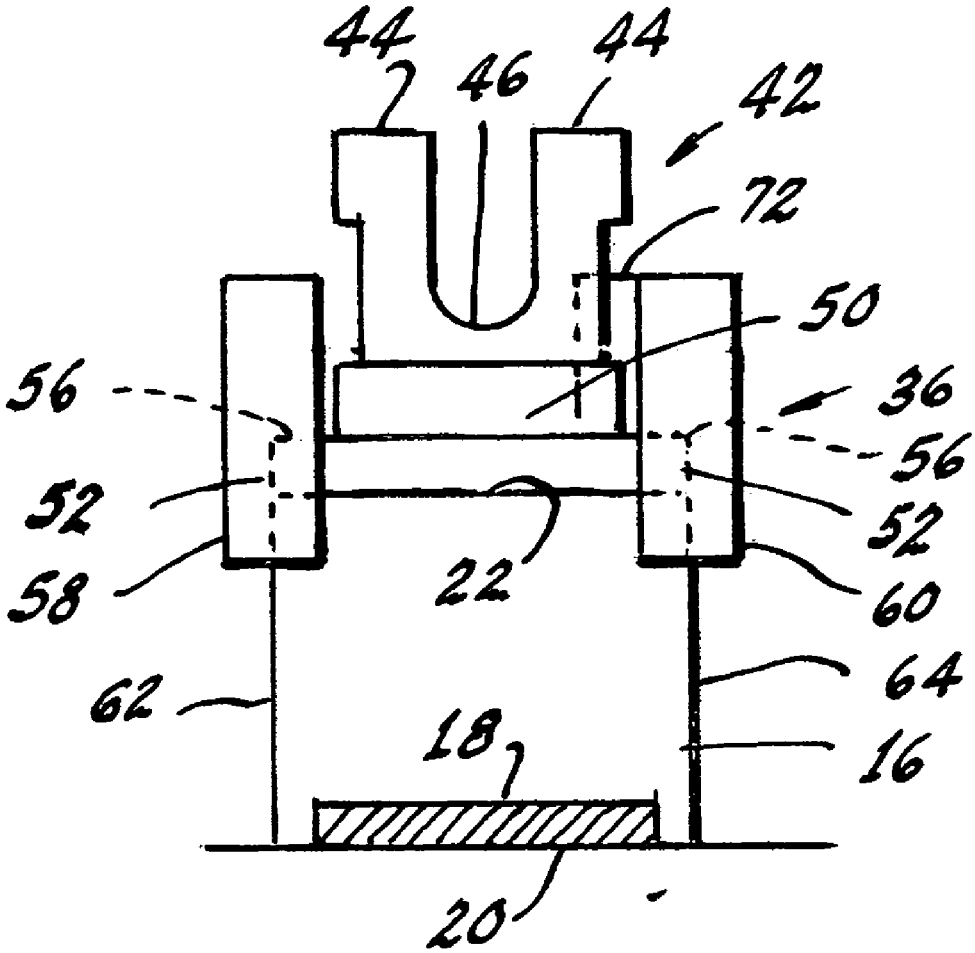
FIG. 3 is an end view of the embodiment of FIG. 1, taken along the line 3-3 of FIG. 1.
Figure 4:
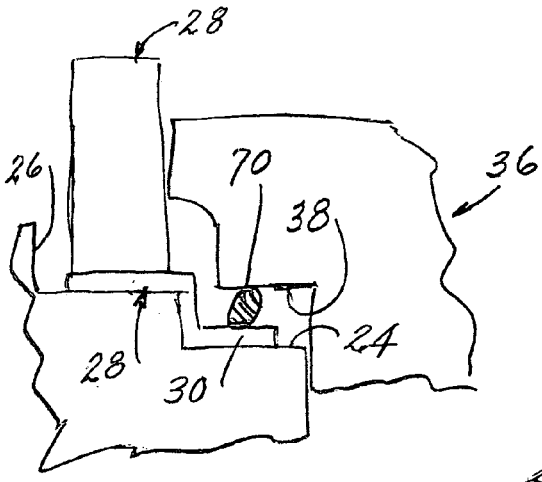
FIG. 4 is an enlarged view of the wire clamping area.
Figure 5:
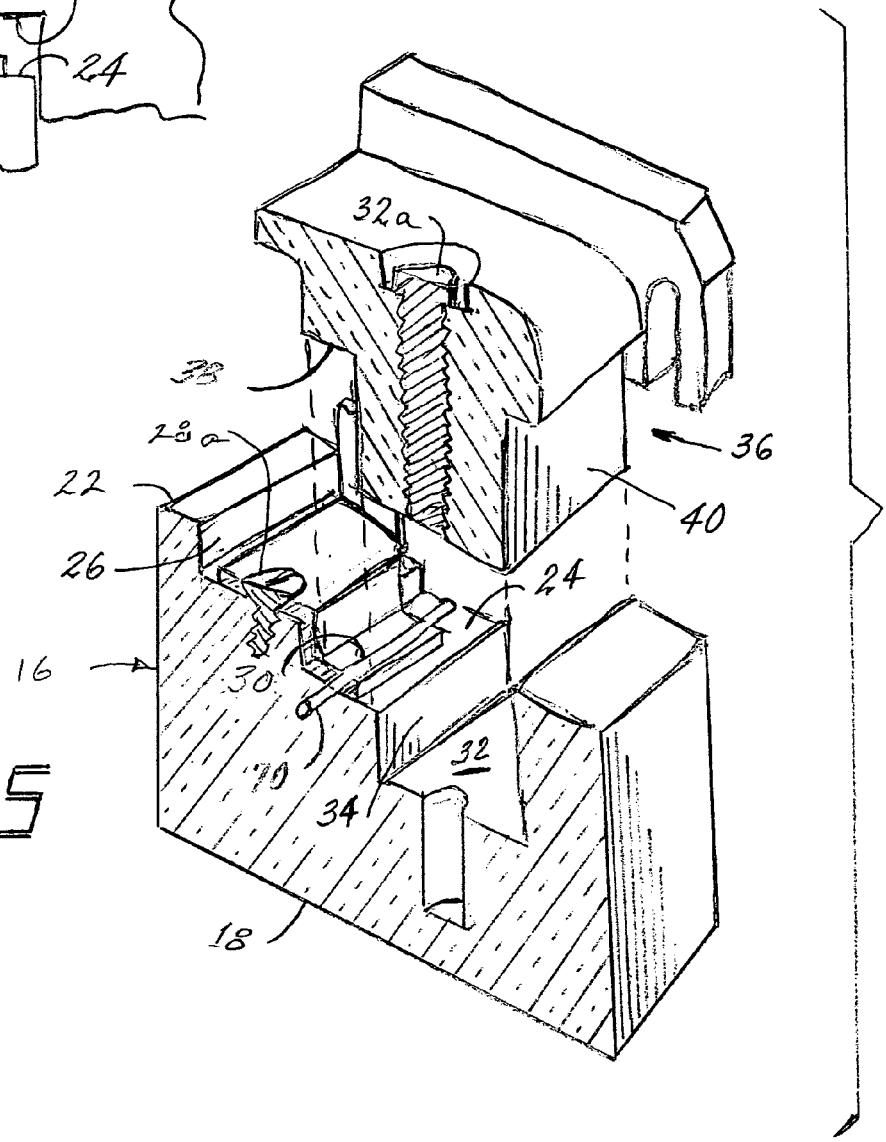
FIG. 5 is an exploded perspective view of the embodiment shown in FIG. 1, with the lever omitted for clarity.

Referring now to the drawings with greater particularity, there is shown in FIG. 1 a socket 10 for a lamp 12 having a projecting electrical contact 14 at least at one end, the lamp and projecting end being shown in phantom lines so as not to obscure the invention. The socket 10 comprises an electrically insulating housing 16 formed of a suitable material, for example, steatite or other high temperature ceramic, having a bottom surface 18 for attachment to a base 20 via bolt 20*a* and an upper surface 22, the upper surface 22 having a wire-receiving groove 24 formed therein. An electrical contact receiving position 26 is formed with the upper surface 22 adjacent the wire receiving groove 24 and an electrical contact 28 is fixed at the electrical contact receiving position 26 via bolt 28*a*. The electrical contact 28 is preferably U-shaped and can be of the type shown in the afore-mentioned U.S. Pat. No. 7,059,888 and it has a tail 30 extending into the wire-receiving groove 24.

A cover receiving position 32 is formed with the upper surface 22 and spaced from the electrical contact receiving position and includes a rectangular depression 34. An electrically insulating cover 36 (preferably of the same material as the housing) is fixed to the cover receiving position by a bolt or screw 32*a* or other adjustable means. The cover 36 further includes a wire-engaging portion 38 that projects into the wire-receiving groove 24 and has a rectangular boss 40 fitted into the rectangular depression 34. A pivotable lever 42 is positioned with and held in place by the cover 36.

The pivotable lever 42 includes arms 44 that define a bight 46 for receiving the projecting electrical contact 14 of the lamp 12 formed at one end 48 of a body 50 and two cylindrical pivot points 52 positioned at another end 54 of the body 50. The two cylindrical pivot points 52 are held in pockets 56 formed in the cover 36.

The cover 36 has sides 58, 60 that extend along the sides 62, 64 of the housing 16 past the upper surface 22, thereby trapping the cylindrical pivot points 52 between the cover 36 and the upper surface 22 of the housing 16. This feature allows the cover bolt 32*a* to be loosened and the cover 32 to be raised for the insertion of the connecting wire 70 into the wire-receiving groove 24 and then tightened to fix the connecting wire 70 into the wire-receiving groove. The lever 42 is thus maintained locked in its desired position during the wire-insertion operation.

The cover 32 has an open back to allow for movement of the lever 42 during its action to remove a lamp 12 and a stop 72 is formed at the leading edge of at least one of the cover walls, for example, wall 64, to control forward movement of the lever 42.

While only one half of socket 10 has been shown, it will be apparent in a preferred form two such sockets will be provided, as shown in the afore-mentioned U.S. Pat. No. 7,059,888.

Thus there is provided a lamp socket that provides good frictional contact with the lamp electrodes and still supplies structure that allows easy removal and replacement of the lamp when that is necessary.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A socket for a lamp having a projecting electrical contact at least at one end, said socket comprising:

an electrically insulating housing having a bottom surface for attachment to a base and an upper surface, said upper surface having a wire-receiving groove formed therein;

an electrical contact receiving position formed with said upper surface adjacent said wire receiving groove;

an electrical contact fixed at said electrical contact receiving position, said electrical contact having a tail extending into said wire receiving groove;

a cover receiving position formed with said upper surface and spaced from said electrical contact receiving position, said cover receiving position including a depression;

an electrically insulating cover fixed to said cover receiving position, said cover including a wire engaging portion projecting into said wire receiving groove and a boss fitted into said depression; and a pivotable lever positioned with and held in place by said cover.

2. The socket of claim 1 wherein said pivotable lever includes arms defining a bight for receiving said projecting electrical contact positioned at one end of a body and two cylindrical pivot points positioned at another end of said body.

3. The socket of claim 2 wherein said two cylindrical pivot points are held in pockets formed in said cover.

4. The socket of claim 3 wherein said cover has sides that extend along the sides of said housing past the upper surface, thereby trapping said cylindrical pivot points between said cover and said upper surface of said housing.

* * * * *